United States Patent [19]

Fox et al.

[11] Patent Number: 4,593,997

[45] Date of Patent: Jun. 10, 1986

[54] RESIDUAL TONER REMOVAL AND COLLECTION APPARATUS

[75] Inventors: Wayne D. Fox; Barry J. Gheer, both of Rochester, N.Y.

[73] Assignee: Xerox Corporation, Stamford, Conn.

[21] Appl. No.: 623,068

[22] Filed: Jun. 22, 1984

[51] Int. Cl.[4] ..... G03G 15/00

[52] U.S. Cl. ..... 355/15; 355/3 DD; 118/652

[58] Field of Search ..... 355/3 R, 15, 3 DD; 118/652

[56] References Cited

U.S. PATENT DOCUMENTS 3,927,937 12/1975 de Keyzer ..... 355/15

FOREIGN PATENT DOCUMENTS 0096974 7/1980 Japan .

0158871 9/1982 Japan ..... 355/15

*Primary Examiner*—Arthur T. Grimley
*Assistant Examiner*—David S. Warren

[57] ABSTRACT

Apparatus for removing toner from a charge-retentive surface and collecting the toner in a receptacle for subsequent disposal thereof. This apparatus is characterized by the provision of a segmented auger structure which is disposed internally of the receptacle such that toner is moved into the receptacle through a vertical one end thereof and positively transported by auger action across the entire length of the receptacle. The segmented auger functions to move toner by means of the two auger sections and causes toner moved by the auger sections to push toner between the two auger sections and between one of the auger sections and the end of the receptacle.

12 Claims, 4 Drawing Figures

RESIDUAL TONER REMOVAL AND COLLECTION APPARATUS

This invention relates to printing machines, and more particularly, to apparatus for collecting and storing particulate material prior to disposal thereof. The apparatus is especially useful for use with toner particles removed from the charge-retentive surfaces of printing machines such as those employing the well known xerographic imaging process.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purposes of the present invention, which relates to the removal and collection of residual toner particles, the latent electrostatic image may be formed by means other than by the exposure of an electrostatically charged photosensitive member to a light image of an original document. For example, the latent electrostatic image may be generated from information electronically stored or generated, and the digital information may be converted to alphanumeric images by imge generation electronics and optics. However, such image generation electronic and optic devices form no part of the present invention.

Although a preponderance of the residual toner (which also contains debris) forming the images is transferred to the paper during transfer, some toner remains on the photoconductive surface, it being held thereto by relatively high electrostatic and/or mechanical forces. It is essential for continued optimum operation that the toner remaining on the surface be thoroughly cleaned therefrom.

A commercially successful mode of cleaning employed in automatic xerography utilizes a brush with soft bristles which have suitable triboelectric properties. While the bristles are soft they are sufficiently firm to effect removal of residual toner particles from the charge-retentive surface.

In addition, webs, belts and blades are known to be useful in cleaning such surfaces, blades being one of the most commonly used toner removal devices in the smaller and slower speed machines commercially available today.

Regardless of how the toner particles are removed from the charge-retentive surface they are either recirculated to the developer housing for reuse or discarded. When the toner particles are reused they are first separated from the debris mixed therewith. The present invention, as mentioned above, is directed to apparatus for collecting the residual toner and then discarding it. Typically the toner removed from the surface is augered to either the front or the rear of the machine to be deposited into a receptacle which is used for temporarily storing the particles and for subsequently removing them from the machine.

By far the most common receptacle utilized for the foregoing purposes is in the form of a bottle into which the toner particles are simply allowed to fall until the bottle is full (i.e. contains all the toner it is capable of handling). This method of collecting the toner particles is somewhat inefficient because the full capacity of the bottle can not be used. This is because the toner first falls to the bottom of the bottle and then builds up in christmas tree fashion until the apex of the tree reaches the mouth of the bottle at the top thereof. As will be appreciated with such an arrangement there are voids between the vertical walls of the bottle and the toner mass forming the christmas tree shape. Thus, all of the bottle's capacity is not utilized. Additionally, since the packing of the toner in the bottle relies solely on gravity rather than a positive packing method the density to which the toner is packed further diminishes the capacity of toner collection.

Another, less common mode of collecting toner particles, comprises, as shown in U.S. Pat. No. 3,927,937, a storage chamber into which toner particles are pumped by an upper and lower roller forming a nip through which the particles are moved into the chamber. The chamber forms a part of a cleaning assembly which assembly must be removed in order to discard the particles collected in the chamber without contaminating other parts of the machine in which it is used. While it was most likely intended by the patentee to utilize available space that had not before possible with prior art devices such utilization is limited because of the increasing forces required to continue to pile the particles higher and higher above the entrance point for the particles.

Still another apparatus for removing and collecting toner is disclosed in an application filed in the United States Patent and Trademark Office on the same day as the instant application. The invention disclosed in the foregoing application is assigned to the same assignee as the invention disclosed herein. As disclosed therein, an auger structure having a single auger segment is employed for conveying toner into a bottle through an opening in a vertical wall thereof.

Apparatus for collecting toner particles and filling a receptacle to capacity that can be removed without spilling the contents thereof is most desirable.

Accordingly, I have provided as disclosed herein a device for collecting toner particles removed from a charge-retentive surface which utilizes substantially the entire volume of the receptacle provided and also packs the toner to a higher density than prior art devices. Moreover, the device I have provided can be removed for discarding of the particles without necessitating the removal of the entire cleaning system.

To these ends the toner collection apparatus disclosed herein comprises a receptacle in the form of a bottle which is supported in its operative position so that the opening therein is disposed at the side thereof. Means for conveying the residual toner removed from the charge-retentive surface is inserted into the bottle.

The aforementioned conveyance means comprises auger structure having a plurality (at least two) of auger segments which are secured to a rotatable shaft. One of the segments is secured to the shaft so that it extends from adjacent one end of the shaft a predetermined distance along the shaft. Another auger segment is secured to the shaft at a distance from the firstmentioned segment. The auger segment adjacent the one end of the shaft communicates with an opening in a vertical 73 section below which part of the auger is disposed for receiving toner to be transported into a receptacle. The toner is pulld into the receptacle by the first auger segment but does not proceed past that auger segment until the receptacle is substantially filled in the area thereof underlying the first auger segment. At this point, toner is pushed into the areas underlying the shaft portion intermediate the two auger segments. Such movement continues until toner reaches the second segment which then pulls toner further into the receptacle. This continues until the area of the receptacle underlying the second auger segment is substantially filled. At this point, toner is then pushed beyond the second auger segment to thereby fill the remainder of the receptacle. The process continues until the receptacle is substantially filled.

Figure 1:
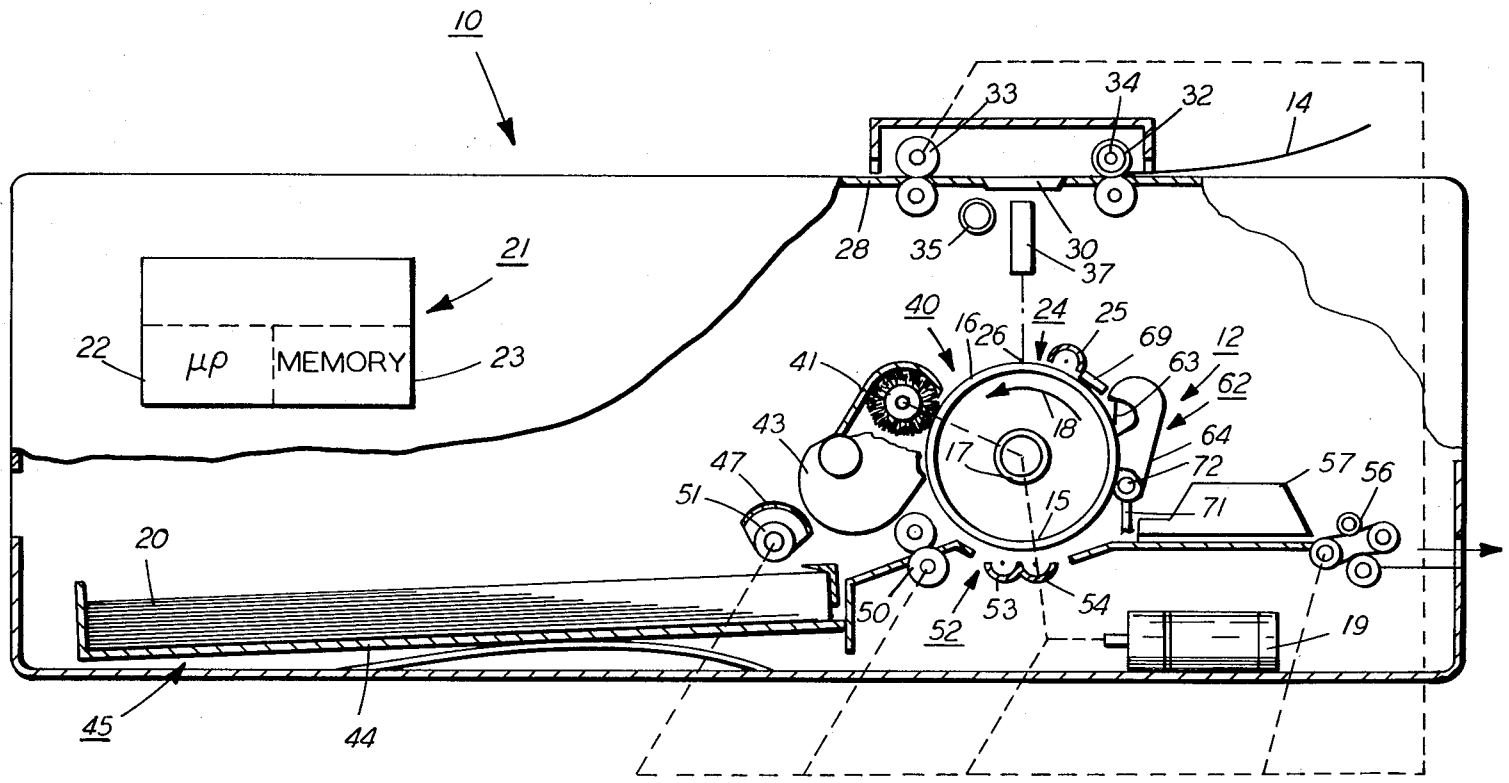
FIG. 1 is a side view depicting a xerographic reproduction machine or printer of the type adapted to incorporate the present invention.

Referring to FIG. 1 of the drawings, there is shown by way of example an automatic xerographic reproduction or printing machine, designated generally by the numeral 10 incorporating a toner removal and collection device 12 of the present invention.

The reproduction machine 10 depicted in FIG. 1 illustrates the various components utilized in machines of this type for producing copies of a document original 14. Although the device 12 of the present invention is particularly well adapted for use in reproduction machine 10, it should become evident from the following description that it is equally well suited for use in a wide variety of other reproduction and printing machine types and systems and is not necessarily limited in application to the particular embodiment of embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33, is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37 which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image on the photoconductive surface 16 of photoreceptor 15 is developed at a development station 40. There, a suitable developer such as magnetic brush roll 41, which is drivingly coupled to main drive motor 19, bring a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet forward into the nip of a registration roll pair 50 which register the copy sheet with the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57, which may, for example, comprise a radiant-type fuser, where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Figure 2:
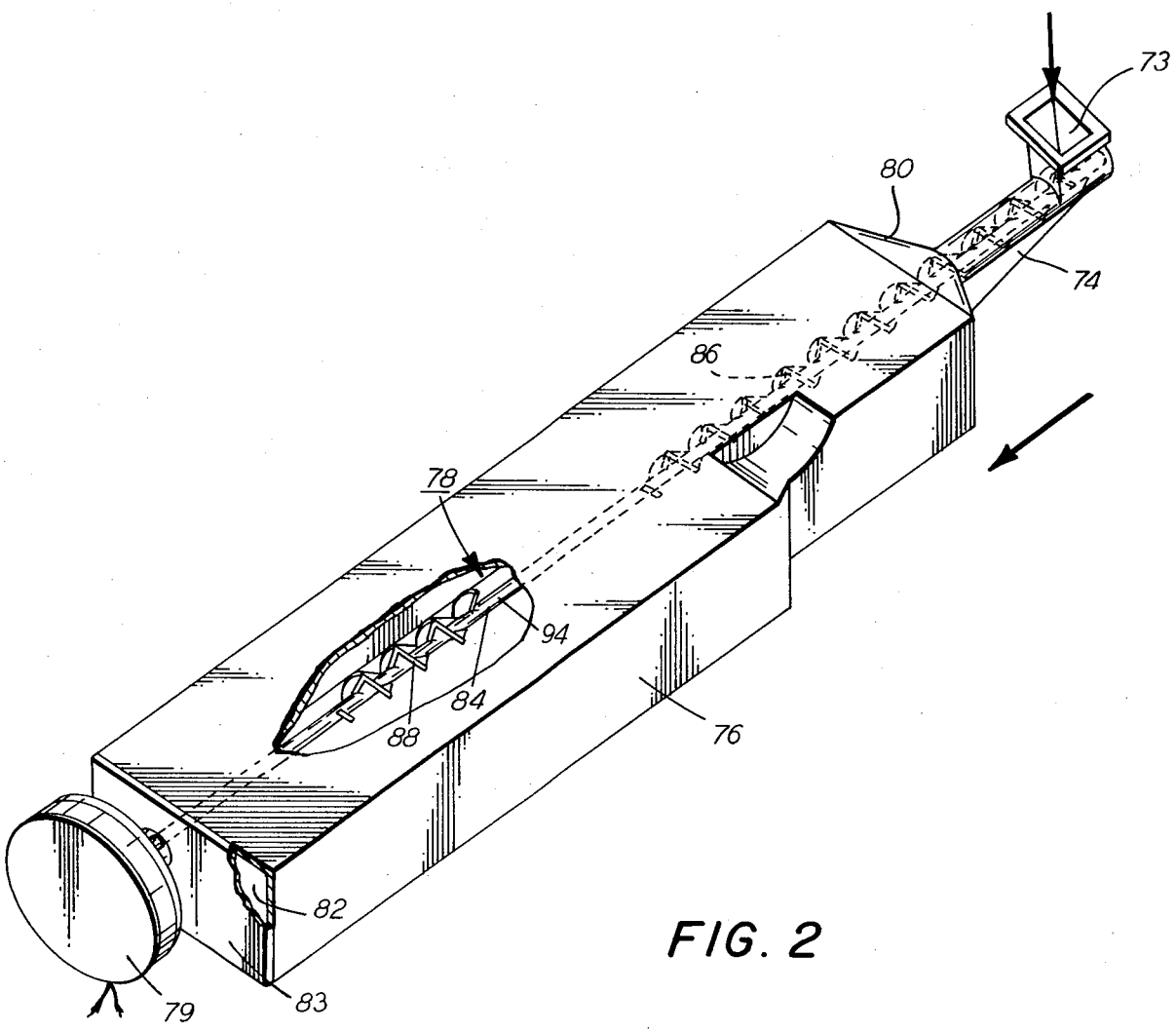
FIG. 2 is a perspective view of a toner collection apparatus representing the present invention.

Following transfer, residual developer remaining on the photoconductive surface 16 of photoreceptor 15 is removed at cleaning station 62 by means of cleaning blade 63 (FIG. 2). Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase drvice 69 is provided for this purpose.

At the cleaning station 62, the cleaning blade 63 is supported in contact with the photoreceptor 15 such that residual toner is chiselled therefrom.

The toner and debris that are removed from the receptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 into a vertical section 73 of an auger housing 74 after which they are conveyed into a receptacle 76 which serves to store the residual toner until the receptacle is full after which it is removed from the machine.

An auger structure 78 is mounted for rotation by a motor 79 within the auger housing 74 and receptacle 76. The auger housing 74 is formed integrally with an end 80 of the receptacle 76. The auger structure 78 is adapted to be installed through an opening 82 at the opposite end of the receptacle. An end closure 83 is provided for sealing the opening 82 once the auger structure is installed.

The auger structure 78, which is preferably fabricated from a thermoplastic material, such as polypropylene, comprises a shaft 84 to which are secured first and second auger segments 86 and 88. The auger segment 86 is attached to the shaft such that it occupies space within the receptacle and within the auger housing 74. One end of the auger segment 86 is disposed at the bottom of the vertical section 73 where it receives toner that has been augered to the opening in the collector 64 by means of the auger 72. The auger segment 86 extends almost into the middle of the receptacle 76 while the auger segment 88 is positioned at approximately the midpoint of the remaining portion of the receptacle. It has been found that this arrangement optimizes packing efficiency and reduces the driving force required.

Figure 3:
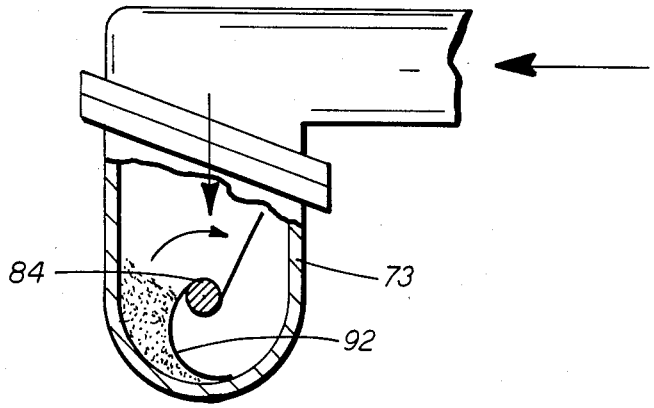
FIGS. 3 and 4 are fragmentary views of FIG. 2 illustrating an antibridging device forming a part of the toner collection apparatus.
Figure 4:
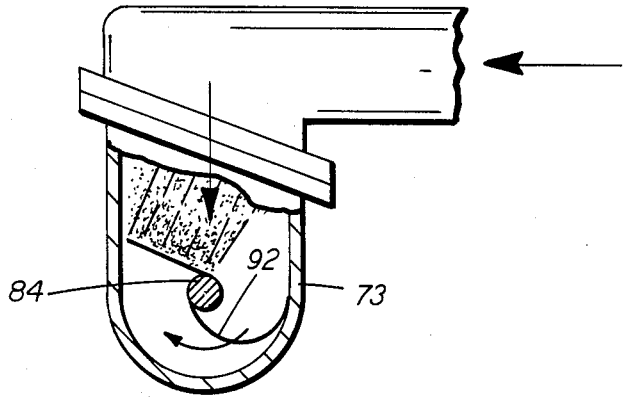

The shaft 84 has flicker members 92 (see FIGS. 3 and 4) attached thereto such that they are disposed adjacent the bottom of the vertical section 73. As the shaft rotates the flicker members deflect against the auger housing walls and then upon further rotation of the shaft they flick toner upward (see FIG. 4) into the open area in the vertical section 73 above the auger. The toner so propelled serves to prevent toner bridging in that area. The flicker members are preferably fabricated from a plastic film material such as Mylar, a trademark of E. I. duPont de Nemours & Company.

The aforementioned conveyance means comprises auger structure having a plurality (at least two) of auger segments which are secured to a rotatable shaft. One of the segments is secured to the shaft so that it extends from adjacent one end of the shaft a predetermined distance along the shaft. Another auger segment is secured to the shaft at a distance from the first mentioned segment. The auger segment 86 adjacent the one end of the shaft communicates with an opening in the vertical 73 section below which part of the auger is disposed for receiving toner to be transported into the receptacle 76. The toner is pushed into the receptacle by the first auger segment but does not proceed past it the second auger segment 88 until the receptacle is substantially filled in the area thereof underlying the first auger segment. At this point, toner is pushed into the area underlying the shaft portion 94 intermediate the two auger segments. Such movement continues until toner reaches the second auger segment which then pulls toner further into the receptacle. This continues until the area of the receptacle underlying the second auger 88 segment is substantially filled. At this point, toner is then pushed beyond the second auger segment to thereby fill the remainder of the receptacle. The process continues until the receptacle is substantially filled.

A packing density on the order of 5.8 grams/cm$^3$ have been attained with the present invention as compared to 3 to 3.5 grams/cm with normal packing densities achieved with systems that rely on dragging toner into a container.

We claim:

1. Apparatus for removing toner from a charge-retentive surface and collecting it for subsequent removal, said apparatus comprising:

means for removing residual toner from said charge-retentive surface;

a receptacle for collecting said residual toner;

means for conveying said residual toner from where it is removed from said charge-retentive surface into said receptacle; said conveying means comprising conduit means and auger means disposed in at least a portion of said conduit means and in said receptacle; and said auger means comprising at least two auger segments interconnected by a shaft and which are at least partially disposed in said receptacle and disposed substantially in a straight line with each other, said auger segments cooperating with each other to effect efficient packing of toner within said receptacle.

2. Apparatus according to claim 1 wherein said auger means comprises said two auger segments secured to a shaft member with a space therebetween.

3. Apparatus according to claim 2 wherein said receptacle includes an opening in a vertical wall thereof through which said residual toner in conveyed.

4. Apparatus according to claim 3 including toner anti-bridging device cooperating with one end of one of said auger segments to prevent toner bridging thereat.

5. Apparatus according to claim 4 wherein said one end of said one of said auger segments is disposed in an auger housing having a vertical section disposed thereabove and through which toner moves, said anti-bridging device being disposed adjacent the bottom of said vertical section.

6. Apparatus according to claim 5 including at least one flicker member secured to said shaft adjacent one end thereof, the length of said flicker member being greater than the radius of said auger segment.

7. Apparatus for removing toner from a charge-retentive surface and collecting it for subsequent removal, said apparatus comprising:

means for removing residual toner from said charge-retentive surface;

a receptacle for collecting said residual toner, said receptacle having an inlet in a vertical wall thereof;

means for conveying said residual toner from where it is removed from said charge-retentive surface into said receptacle; said conveying means comprising means disposed within said receptacle intermediate the top and bottom walls for conveying toner into a first portion of said receptacle and substantially filling said first portion prior to the commencement of the filling of a successive portion of said receptacle said first portion being closer to said inlet than said successive portion.

8. Apparatus according to claim 7 wherein said intermediately disposed means comprises two auger segments secured to a shaft member with a space therebetween.

9. Apparatus according to claim 8 wherein there is a space between one of said auger segments and the end of said shaft.

10. Apparatus according to claim 9 wherein said receptacle includes an opening in a vertical wall thereof through which said residual tone is conveyed.

11. Apparatus according in claim 10 including toner anti-bridging device cooperating with one end of one of said auger segments to prevent toner bridging thereat.

12. Apparatus according to claim 11 wheren said one end of said one of said auger segments is disposed in an auger housing having a vertical section disposed thereabove and through which toner moves, said anti-bridging device being disposed adjacent the bottom of said vertical section.

* * * * *